US007841472B1

(12) United States Patent
Williams

(10) Patent No.: US 7,841,472 B1
(45) Date of Patent: Nov. 30, 2010

(54) GUN CLEANING KIT TOOL INSERT

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 0 days.

(21) Appl. No.: 12/688,392

(22) Filed: Jan. 15, 2010

(51) Int. Cl.
*B65D 71/00* (2006.01)

(52) U.S. Cl. ..... 206/579; 206/373

(58) Field of Classification Search ..... 206/576, 206/577, 579, 315.1, 317, 372, 373; 190/102, 190/109, 110
See application file for complete search history.

(56) References Cited

U.S. PATENT DOCUMENTS 2,623,566 A * 12/1952 Kibler ..... 190/125
5,427,239 A * 6/1995 Hunt ..... 206/372
5,829,502 A * 11/1998 Distefano et al. ..... 150/113
5,947,286 A * 9/1999 Chau ..... 206/372
6,481,577 B1 * 11/2002 Roegner ..... 206/581
6,655,529 B2 * 12/2003 Ho ..... 206/373
6,715,594 B2 * 4/2004 Milionta et al. ..... 190/110
7,165,673 B2 1/2007 Marks
7,356,961 B2 4/2008 Williams
7,726,478 B2 * 6/2010 Potterfield et al. ..... 206/317
2010/0175296 A1 * 7/2010 Williams ..... 42/95

* cited by examiner

*Primary Examiner*—Jacob K Ackun, Jr.
(74) *Attorney, Agent, or Firm*—Marjama Muldoon Blasiak & Sullivan LLP

(57) ABSTRACT

A firearm cleaning kit includes a case, a fastener, a tool insert, and firearm cleaning tool. The case includes a first side and a second side joined along a fold line. The fastener joins the first and second sides of the case together. The tool insert is secured to an interior region of the case, and includes a base portion joined to a flexible back plate. The base portion includes a tool base cavity, and the flexible back plate includes a raised wall defining a tool tip enclosure in alignment with the tool base cavity. The firearm cleaning kit further includes a firearm cleaning tool. The firearm cleaning tool includes an attachment base secured within the tool base cavity of the base portion, and a tool tip ensconced within the tool tip enclosure.

20 Claims, 13 Drawing Sheets

GUN CLEANING KIT TOOL INSERT

FIELD OF THE INVENTION

This invention relates generally to the field of firearm cleaning kits, and more particularly to a storage compartment for a firearm cleaning kit.

BACKGROUND OF THE INVENTION

Proper cleaning of a firearm after use is essential to ensuring the firearm retains its accuracy, safety, and reliability. With each firing, the breech and bore of a firearm accumulate residue such as powder, priming compound, and copper fragments from ammunition casings. In addition, environmental elements such dirt, snow, and moisture can accumulate in the bore, causing further fouling. Fouling and debris may also accumulate in the firearm's action due to its design, or improper maintenance. Failure to remove the residue and debris results in a decrease in the firearm's accuracy and precision, and may even pose a safety hazard to the operator. Therefore, proper cleaning is one of the most important elements of firearm ownership.

Civilians who shoot and clean firearms often devise their own storage cases to store firearm cleaning materials. An example is an empty ammunition can. In many instances, firearm owners also fashion their own tools to aide in the cleaning process. However, these homemade storage cases and cleaning tools are generally not portable or lightweight. When cleaning a firearm, components or cleaning tools may be set aside during the cleaning process and, due to their small size, may be misplaced or lost. Therefore, civilians have a need for a lightweight and compact firearm cleaning kit that stores cleaning tools and provides additional storage capability.

Military personnel need to be able to clean their weapons in the field, preferably immediately after shooting so that their firearm is ready for use at all times. An important aspect of the cleaning process is that the cleaning kit be compact and lightweight, organized, and able to store firearm components or spare tools and cleaning supplies. Therefore, military personnel also need for a lightweight and compact firearm cleaning kit that stores cleaning tools and provides additional storage capability for the cleaning of military weapons.

To answer the need for portable, compact, and lightweight storage cases for firearm cleaning materials and tools, many different types of firearm cleaning kits have been designed for military and consumer use. Specialized, compact cleaning kits have been custom-designed to store the precise tools and components needed to thoroughly clean a particular firearm. For example, firearm cleaning tool kits have been designed to store specific cleaning tools such as brushes, picks, scrapers, and rods.

SUMMARY OF THE INVENTION

Although prior art firearm cleaning tool kits with specialized tools may provide adequate storage, some kit owners experience difficulty removing and securing the tools. A firearm cleaning kit is disclosed having a flexible tool insert that aides in the storage and removal of tools. In one aspect of the invention, a firearm cleaning kit includes a case, a fastener, a tool insert, and firearm cleaning tool. The case includes a first side and a second side joined along a fold line. The fastener joins the first and second sides of the case together. The tool insert is secured to an interior region of the case, and includes a base portion joined to a flexible back plate. The base portion includes a tool base cavity, and the flexible back plate includes a raised wall defining a tool tip enclosure in alignment with the tool base cavity. The firearm cleaning kit further includes a firearm cleaning tool. The firearm cleaning tool includes an attachment base secured within the tool base cavity of the base portion, and a tool tip ensconced within the tool tip enclosure.

In another aspect of the invention, the tool insert is releasably secured to the interior of the case by an attachment element.

In one example, the attachment element includes a fixed portion and a detachable portion. The fixed portion is permanently secured to the interior region of the case and the detachable portion slideably engages the fixed portion.

In yet another aspect of the invention, the tool insert includes a plurality of tool base cavities within the base portion and a plurality of raised walls defining a plurality of tool tip enclosures. Each tool tip enclosure is aligned with the corresponding tool base cavity.

In yet another aspect of the invention, the tool insert has a first side and an opposing second side. The first side includes a plurality of first side tool base cavities and a plurality of corresponding first side raised walls defining a plurality of first side tool tip enclosures. The second side includes a plurality of second side tool base cavities and a plurality of corresponding second side raised walls defining a plurality of second side tool tip enclosures. The first and second side tool base cavities are formed within the base portion of the tool insert.

In one example, the raised walls on one side of the tool insert are spaced a distance D from each other, and the distance D is sufficient to allow the first side tool base cavities to be arranged in an alternating pattern with the second side tool base cavities within the base portion.

In yet another aspect of the invention, the firearm cleaning kit further includes a plurality tool inserts secured to the interior of the case by a single attachment element.

In one example, each tool insert includes a detachable portion, and the single attachment element includes a single fixed portion and the plurality of detachable portions.

BRIEF DESCRIPTION OF THE DRAWINGS

For a further understanding of the invention, reference will be made to the following detailed description of the invention which is to be read in connection with the accompanying drawing, wherein.

DETAILED DESCRIPTION OF THE INVENTION

Figure 1:
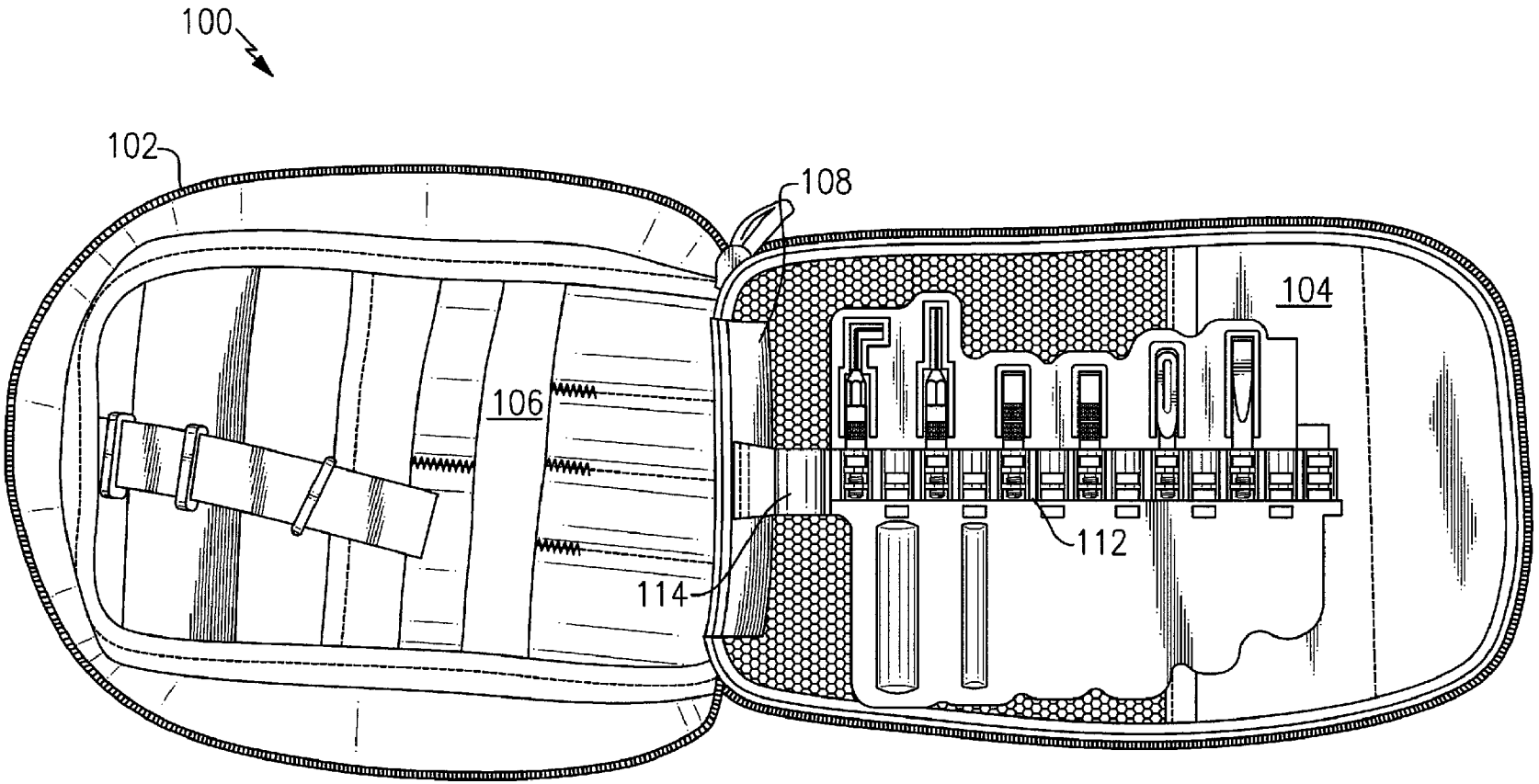
FIG. 1 schematically illustrates a perspective exterior view of a firearm cleaning kit according to an embodiment of the invention.

Referring to FIG. 1 of the drawings, a firearm cleaning kit 100 includes case 102 having a first side 104 and a second side 106 separated by a fold line 108. Each side may define an interior region or compartment, for example. The fold line 108 joins the first side 104 to the second side 106, allowing the two to be folded up in a clamshell-type arrangement. In the embodiment shown, the case 102 is generally rectangular in shape, but any shape that permits the first side 104 and the second side 106 to be folded together in clamshell fashion is suitable. For example, the case 102 could be circular or oval in shape. The case 102 may be made from a soft, durable fabric, or may be a rigid, hard shell construction if increased toughness is required. In the embodiment shown, the case 102 is constructed of nylon fabric to allow some compression.

The kit 100 further includes a fastener 110 to secure the first side 104 to the second side 106 when the case 102 is in the closed position. The fastener 110 in the disclosed embodiment is a zipper, configured to zip along three sides of the case 102. Other fastener configurations are possible. For example, the fastener 110 may be one or more snaps, flexible strips such as VELCRO® brand fasteners, or ties. The fastener 110 in the preferred embodiment is a silent zipper due to its strength, ease of use, and quiet operation.

Figure 2:
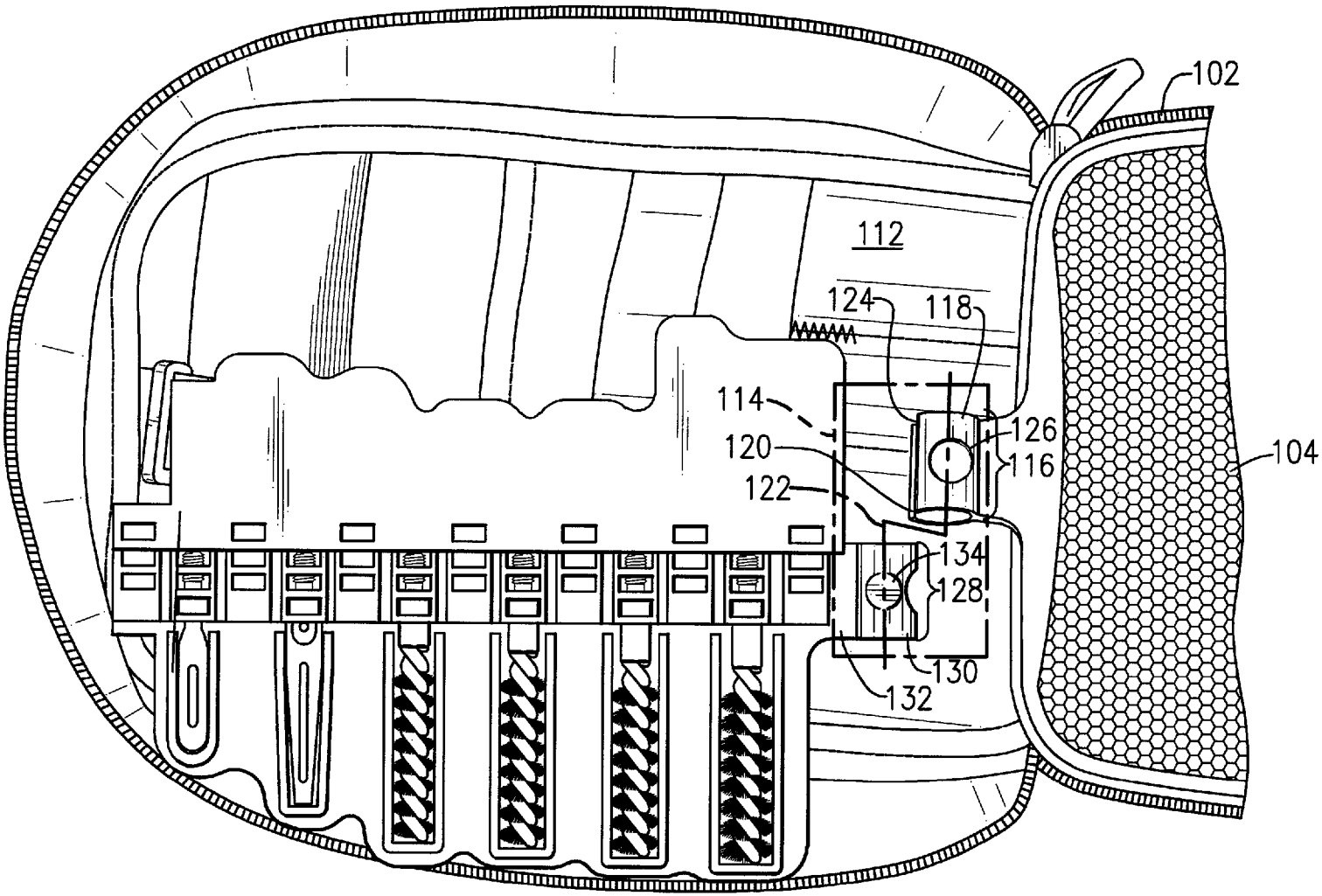
FIG. 2 schematically illustrates an exemplary embodiment of the attachment element shown in FIG. 1.

The firearm cleaning kit 100 further includes at least one tool insert 112 secured to the interior of the case 102 by an attachment element 114. In one example, the attachment element 114 is secured to the fold line 108. The attachment element 114 may permanently secure the tool insert 112 to the case 102 or, as disclosed herein, the attachment element 114 may provide a means to release the tool insert 112 from the case. Referring now to FIG. 2, the attachment element 114 is shown with the tool insert 112 detached from the case 102. A fixed portion 116 of the attachment element 114 is sewn or otherwise permanently secured to the fold line 108 on the interior of the case 102. In the disclosed embodiment, the fixed portion 116 includes a thin-wall clamp 118 defining a bore 120 along a longitudinal axis 122 therethrough. The axis 122 is oriented generally along the fold line 108. The clamp 118 further includes a slot 124 oriented along the longitudinal axis 122 and an engagement recess 126 aligned perpendicular to the longitudinal axis.

A detachable portion 128 of the attachment element 114 includes a cylindrical element 130 joined to the tool insert 112 by a stem 132. The cylindrical element 130 includes a raised detent 134 on the cylindrical surface. To secure the tool insert 112 to the case 102, the stem 132 of the cylindrical element 130 is aligned with the slot 124 on the fixed portion 116 of the attachment element 114, which also aligns the detent 134 with the engagement recess 126. The cylindrical element 130 slideably engages the bore 120 until the detent 134 snaps into the engagement recess 126.

The disclosed arrangement is only one example of an attachment element 114. In another arrangement, the cylindrical element 130 is secured to the fixed portion 116, and the clamp 118 is secured to the detachable portion 128. In another example, the attachment element 114 may be a stand-alone structure that secures to the tool insert 112 on one end and the case 102 on the other end. In a yet another example, the attachment element 114 may comprise snaps, VELCRO® brand fasteners, or the like.

Figure 3:
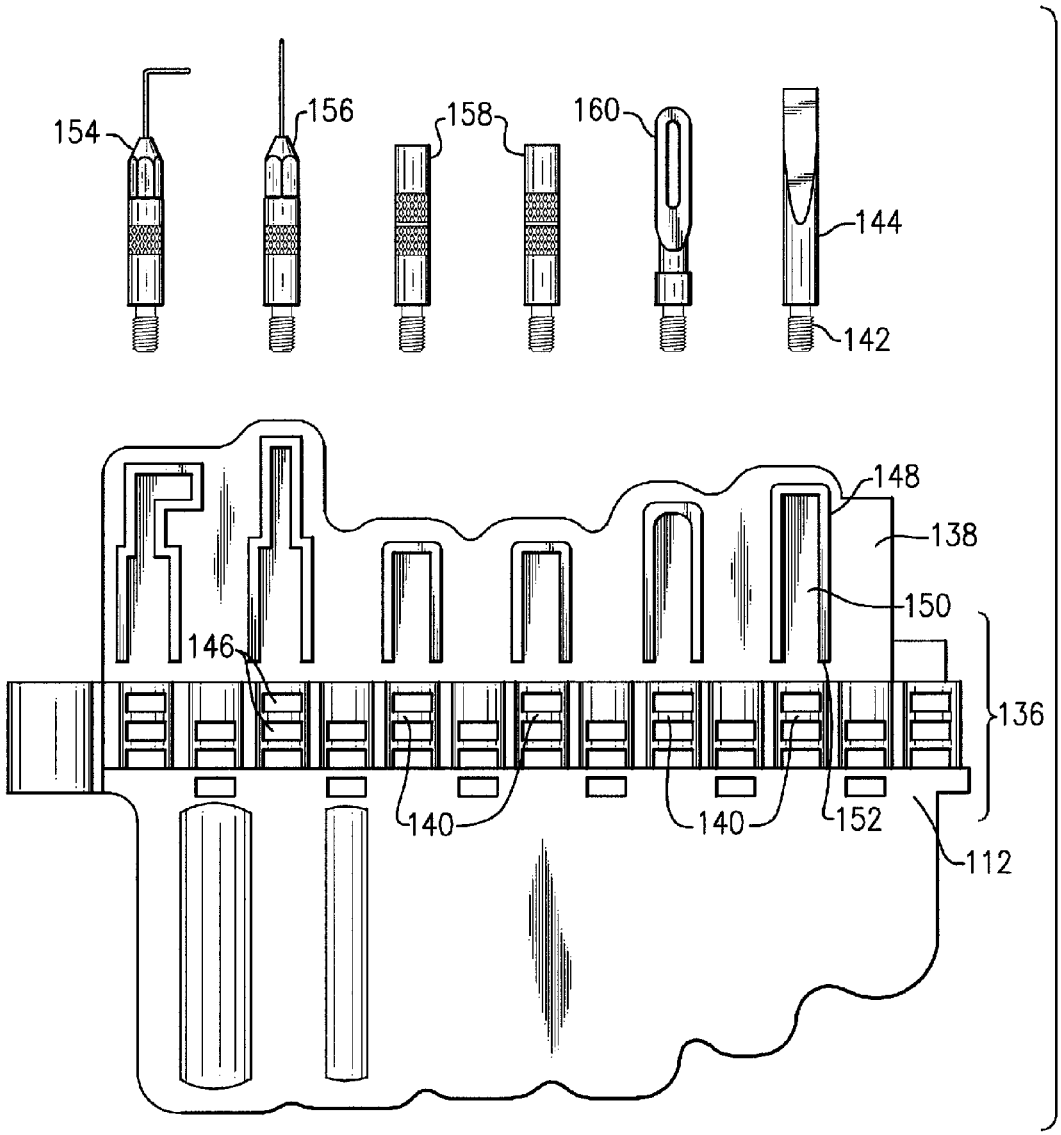
FIG. 3 schematically illustrates a perspective exterior view of the tool insert shown in FIG. 1.

Referring now to FIG. 3 of the drawings, the tool insert 112 is shown in greater detail, detached from the case 102. The tool insert 112 includes a base portion 136 joined to a flexible back plate 138. The base portion 136 includes a tool base cavity 140 configured to accept the shank 142 of a firearm cleaning tool 144. In the disclosed embodiment, the base portion 136 may include a plurality of slots 146. The slots 146 are primarily to prevent air from becoming entrapped in the tool base cavity 140 during molding, or when the firearm cleaning tool 144 is inserted into the cavity. The tool base cavity 140 may be sized to snugly accept the firearm cleaning tool 144 to prevent the tool from slipping out.

The flexible back plate 138 includes a raised wall 148 defining a tool tip enclosure 150. The raised wall 148 is shaped to ensconce and protect the particular type of cleaning tool being stored. For example, the cleaning tool 144 may be a scraper. The raised wall 148 will form a generally rectangular shape, as illustrated. In other examples, the cleaning tool 144 may be a right-angle pick, and the raised wall 148 will form an L-shaped enclosure 150. The possible shapes of the raised wall 148 are as varied as the types of tools being stored, as will be described in more detail below.

To provide flexibility, the tool insert 112 may comprise a rubber compound such as tetrafluoroethylene (TFE). Depending upon the choice of material, the tool insert 112 may be injection molded to form a unitary, one-piece construction. The raised wall 148 and tool tip enclosure 150 are aligned with the tool base cavity 140 to provide a unitary holding structure. In one embodiment, the raised wall 148 is formed integral with tool base cavity 140. In another embodiment, a relief 152 may be provided between the raised wall 148 and the tool base cavity 140. The relief 152 allows the flexible back plate 138 to deflect a greater degree during replacement and removal of tools.

Still referring to FIG. 3, the tool insert 112 may further include a plurality of tool base cavities 140 aligned along the base portion 136 to hold respective cleaning tools 144 therein. In the illustrated embodiment, the cavities 140 are identically sized because the shank 142 of each tool is similar. As shown, the tool insert 112 is adapted to secure a variety of firearm cleaning tools such as a right-angle pick 154, a straight pick 156, a centerpiece 158, and a slotted tip 160.

Figure 4A:
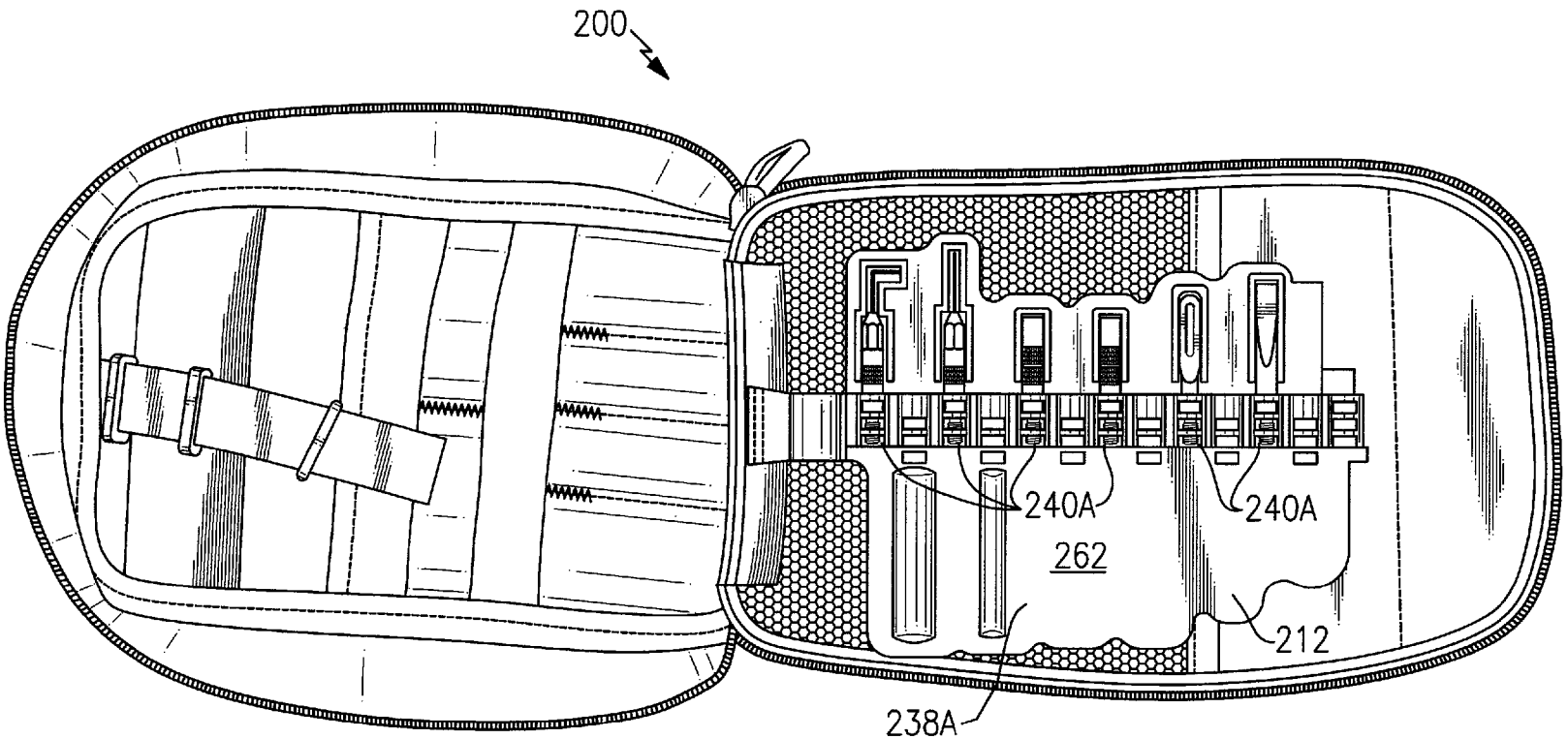
FIGS. 4A and 4B schematically illustrate an interior view of the firearm cleaning kit according to another embodiment of the invention.
Figure 4B:
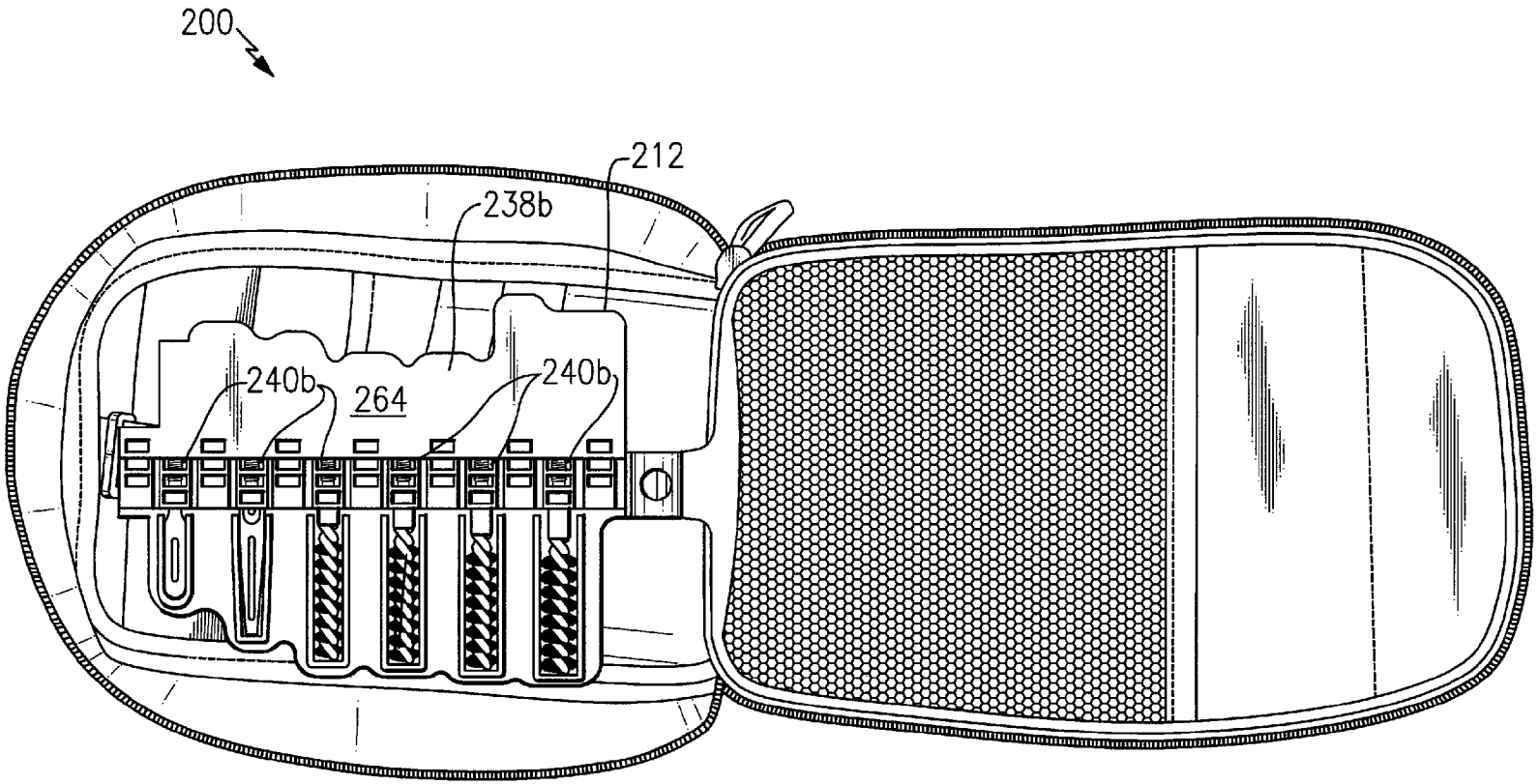

Referring to FIGS. 4A and 4B, wherein like numerals indicate like elements from FIGS. 1-3, a firearm cleaning kit 200 includes a tool insert 212 that is double-sided to provide additional tool storage in a compact space. FIG. 4A illustrates a first face 262 of the tool insert 212, essentially as described in relation to FIG. 3, and FIG. 4B illustrates a second face 264 of the tool insert. The first face 262 and the second face 264 include a plurality of tool base cavities 240*a* and 240*b*, respectively, as well as flexible back plates 238*a* and 238*b*. As can be seen with reference to FIG. 4A, the smooth planar surface below the tool base cavities 240*a* forms the back side of the flexible back plate 238*b* on the second face 264 (FIG. 4B).

Figure 5:
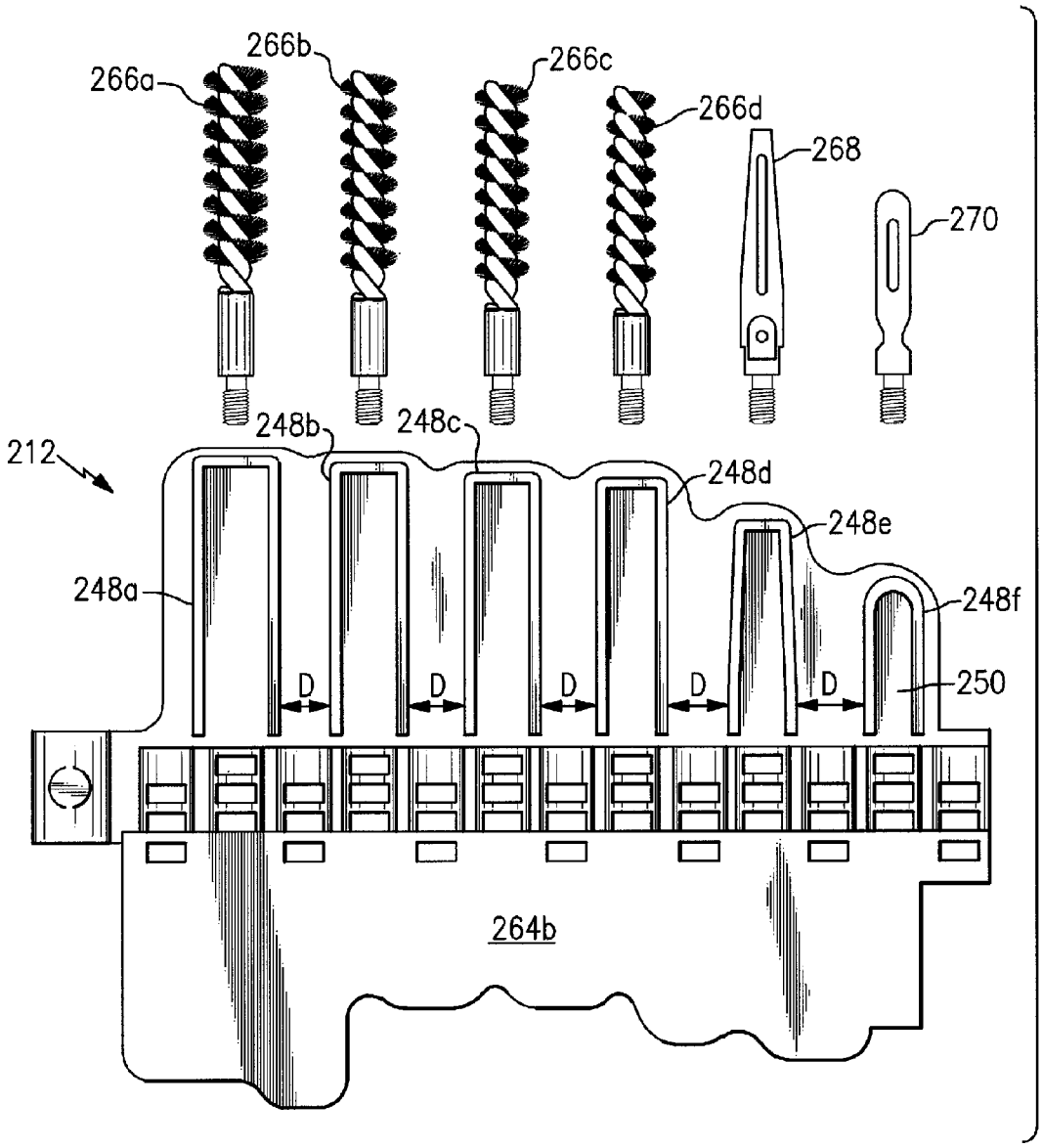
FIG. 5 schematically illustrates the tool insert of FIG. 4B.

Referring to FIG. 5, the second face 264 of the tool insert 212 is shown in greater detail, detached from the case 202. The second face 264 of the tool insert 212 includes a plurality of tool base cavities 240*b* and corresponding raised walls 248*a-f*. The raised walls 248*a-f* are spaced a distance D apart from each other, for example. In one embodiment, the distance D is sufficient to allow the tool base cavities 240*a* and 240*b* to be arranged in an alternating pattern, such that the distance D on one side forms the back side of the raised wall 248 and tool tip enclosure 250 on the other side. In the disclosed embodiment, the second face 264*b* of the tool insert 212 is adapted to secure a variety of firearm cleaning tools such as bore cleaning brushes 266*a*-266*d*, an angled pick 268, and a second slotted tip 270.

Prior art tool inserts have included a foamed rubber pad glued to a thin, rigid backing. Cutouts in the foamed rubber pad held the various firearm cleaning tools. One problem with this arrangement is that removal of the tool was difficult because the tool was recessed deep into the foamed rubber. In one example, grasping the brass bristles of a bore cleaning brush could prick a user's finger. In another example, the user could slice their finger grasping a sharp tool such as a scraper. Also, the foamed rubber did not always provide the adequate protection for the tools if they were struck hard, such as when the case was dropped.

Figure 6:
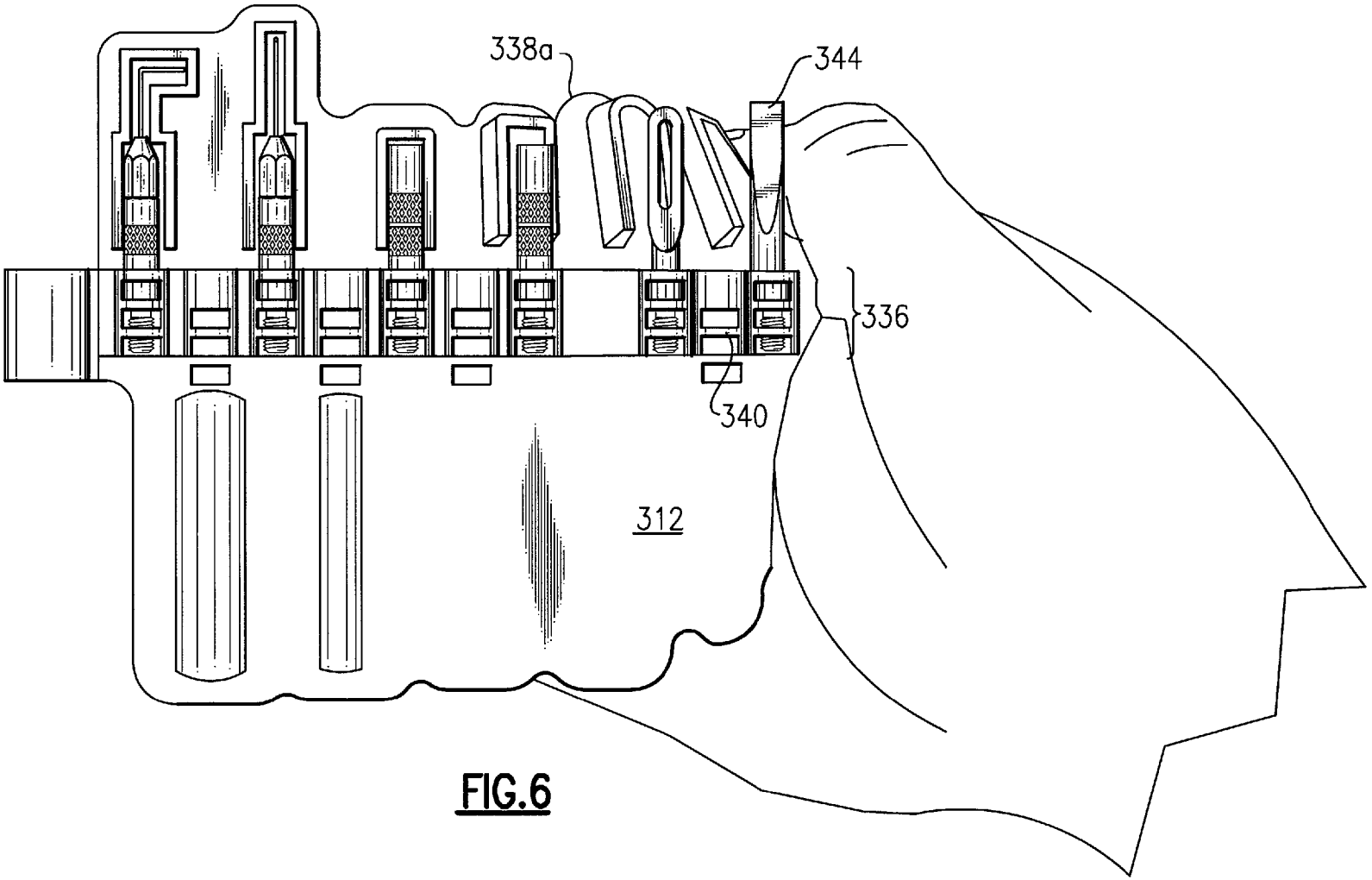
FIG. 6 schematically illustrates a method to remove and replace the tool shown in FIG. 5.

Referring to FIG. 6 of the drawings, wherein like numerals indicate like elements from FIGS. 1-5, a method to remove or install firearm cleaning tools is illustrated using the flexible back plate 338*a* of the present invention. The described method alleviates the problems encountered in the prior art tool inserts. To remove a tool, the base portion 336 of the tool insert 312 is grasped firmly. Alternatively or simultaneously, the back plate 338*b* of the opposing side (not shown) may also be grasped. While grasping the base portion 336, the flexible back plate 338*a* is bent away from the base portion, as illustrated, thereby exposing the tip portion of the firearm cleaning tool 344 that is no longer ensconced in the tool tip enclosure. still retained in the tool base cavity. The tool 344 may grasped towards the shank 342 and removed without exposing the user to the hazards associated with the sharp edges of the tool tip. To replace the tool 344, the same method is utilized in reverse order. Bending the flexible back plate 338*a* away from the base portion 336 better exposes the tool base cavity so the tool 344 may be easily replaced.

Figure 7:
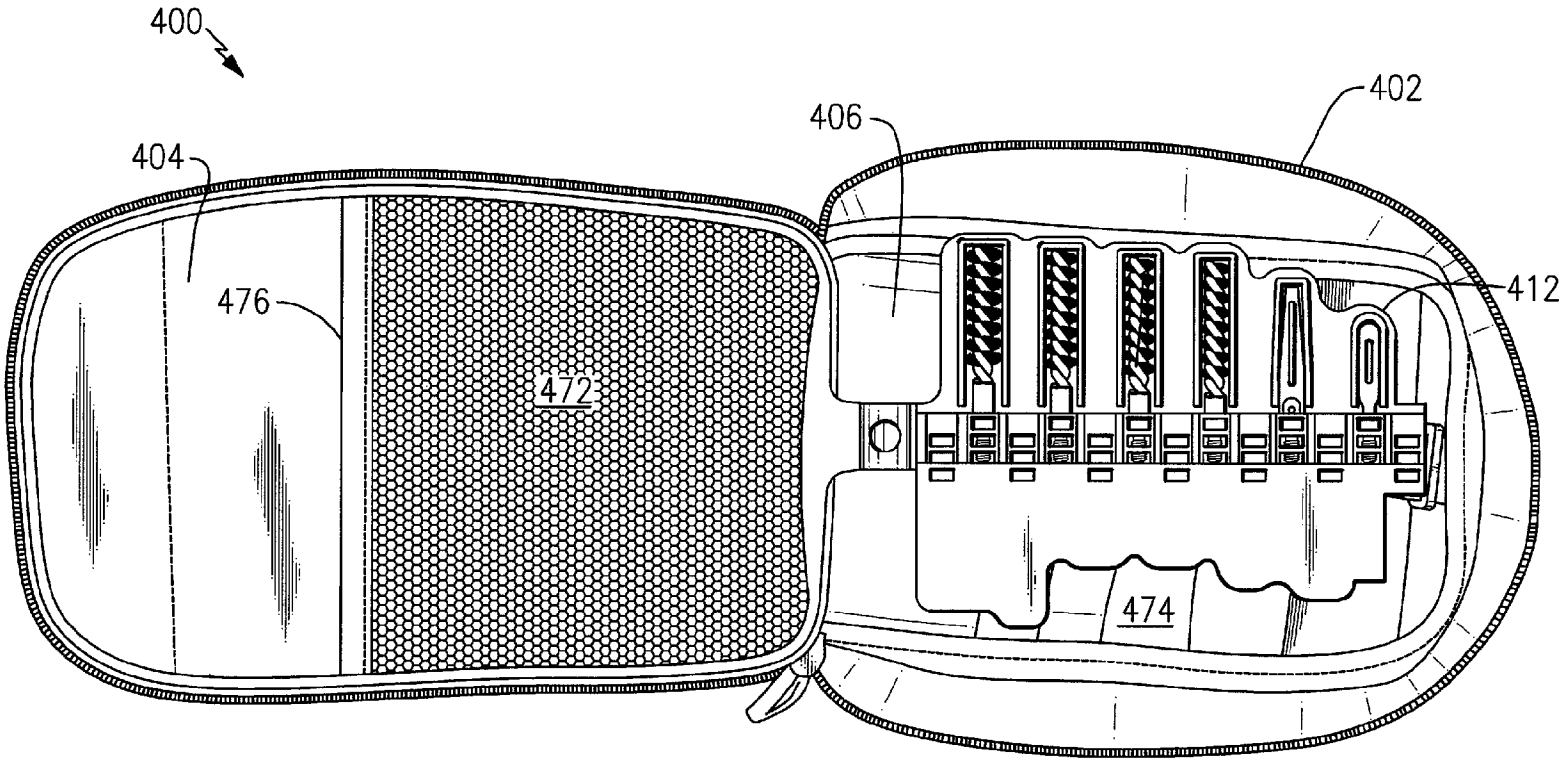
FIG. 7 schematically illustrates an interior view a firearm cleaning kit according to another embodiment of the invention.

Referring to FIG. 7, in another embodiment a firearm cleaning kit 400 further includes a case 402 having a first interior region 472 defined by a first side 404, and a second interior region 474 defined by a second side 406. A pocket 476 sewn into the first interior region 472 and/or the second interior region 474 of case 402 holds cleaning materials such as a flexible cleaning rod and bore patches (not shown). The kit 400 further includes a tool insert 412 in accordance with the present invention, in any of the above-described embodiments.

Figure 8:
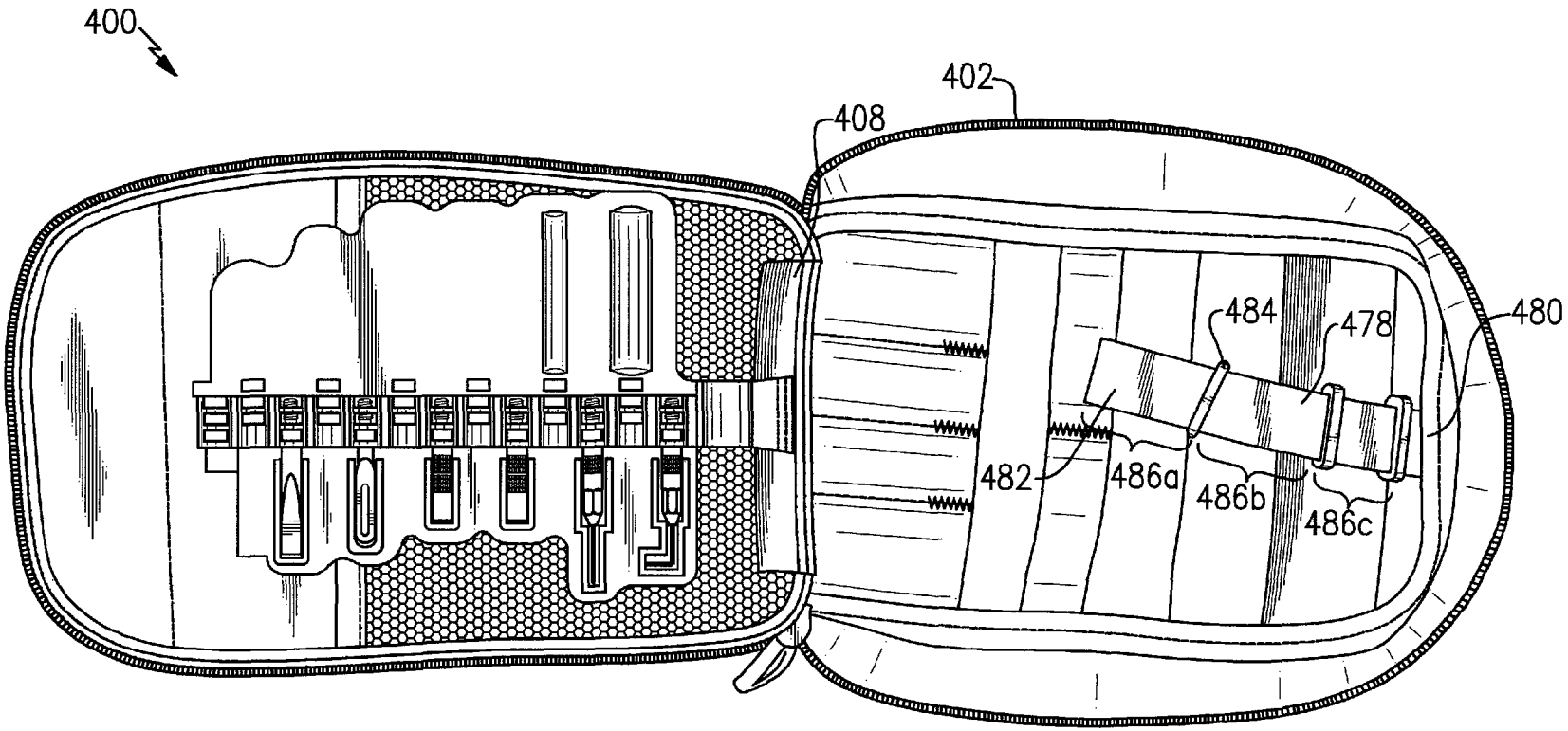
FIG. 8 schematically illustrates an alternate view of the firearm cleaning kit of FIG. 7.

Referring to FIG. 8, the firearm cleaning kit 400 further includes a length of material formed into a closed loop, hereinafter referred to as loop 478. The loop 478 is affixed to the case 402 at a fixed end 480, leaving a free end 482 distal to the fixed end. The width of the material is substantially greater than the material thickness, so as to aide in forming a storage compartment, as will be discussed below. In the disclosed embodiment, the material is elastic, approximately 0.75 inches in width, and approximately 0.045 inches thick. The length of the material is such that when doubled over to form the loop, the loop nests into the case 402. The loop 478 may be fixed to the case 402 at any convenient location. In the disclosed example, the loop 478 is affixed to the fold line 408. However, the loop 478 may be affixed to the first or second interior region, or the exterior of the case.

A divider piece 484 has a single slot therethrough. The slot width is slightly greater than the width of the elastic material. In the disclosed embodiment, the width of the slot is approximately 0.80 inches. The slot height is dimensioned to be no more than twice the thickness of material. In the disclosed embodiment, the height of the slot is approximately 0.08 inches.

The divider piece 484, coupled with a portion of the loop 478, forms an adjustable storage compartment 486. FIG. 8 depicts a plurality of storage compartments 486*a*-486*c*. The storage compartment 486 is formed by inserting the free end 482 of the loop 478 through the slot in the divider piece 484, and sliding the divider piece along the length of the loop 478 until the desired width is achieved. Since the width of the slot is slightly larger than the width of the elastic material, and the slot height is no more than twice the thickness of material, the doubled-over thickness of the material forming the loop 478 causes a slight friction fit in the slot. In this manner, the divider piece 484 is able to slide along the length of the loop 478 with a small amount of force, e.g., greater than the friction force, but is held in place when the sliding force is released. By virtue of this configuration, the width of the storage compartment 486 is both adjustable and self-locking. In the preferred embodiment, the doubled-over thickness of material is approximately 0.09 inches, or 0.01 inches greater than the height of the slot. In order to insert the loop 478 through the slot, the elastic material must be stretched to decrease its thickness.

Figure 9B:
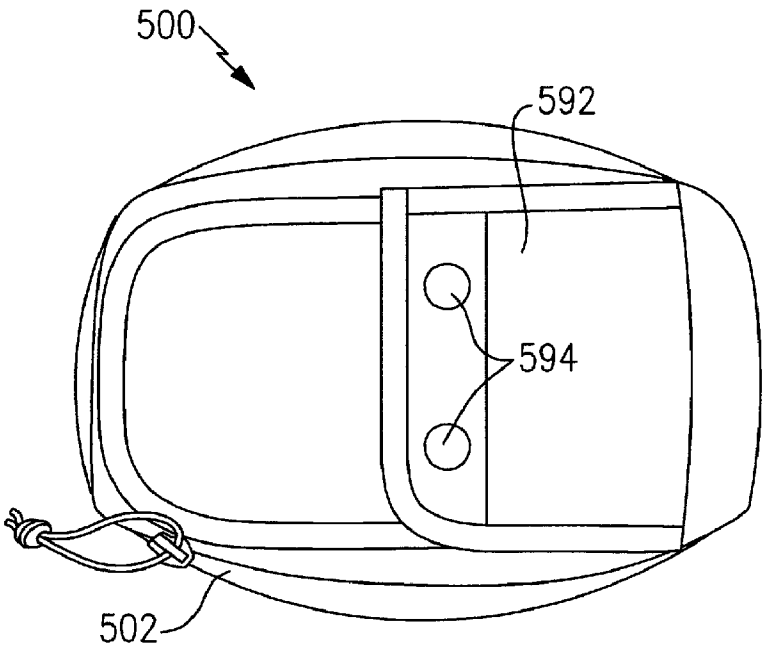
FIGS. 9A and 9B schematically illustrate an exterior view of a firearm cleaning kit according to another embodiment of the invention.
Figure 9A:
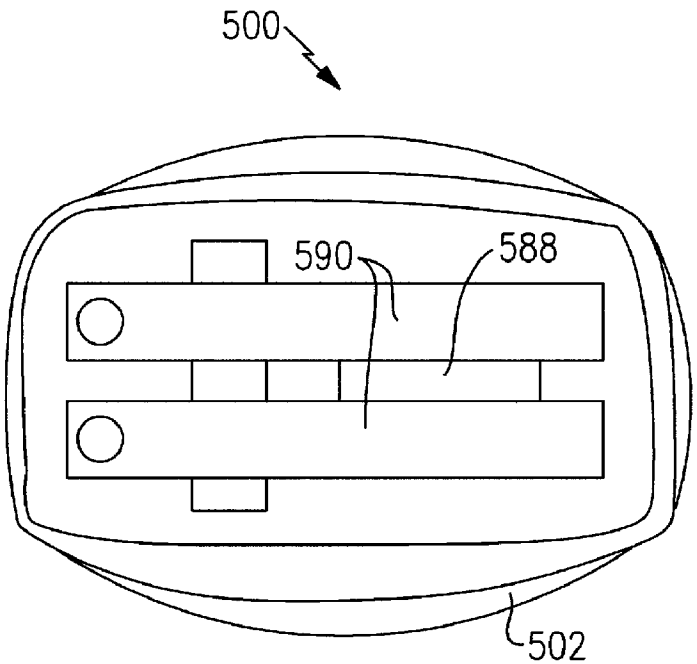

Referring to FIGS. 9A and 9B, in another embodiment a firearm cleaning kit 500 further includes a belt attachment 588 affixed to the exterior of the case 502. In one embodiment, the belt attachment 588 comprises a rugged strip of nylon fabric sewn at each end to the case 502, thereby forming a loop through which a belt (not shown) may be passed. The kit 500 may further include one or more straps 590 to secure the case 502 to a backpack or the like. The exterior of the case 502 may include an exterior pocket 592 with snaps 594 to protect the pocket contents from external elements. Other means of configuring the exterior pocket 592 are possible; for example the snaps 594 may be replaced by VELCRO® brand fasteners.

Figure 10B:
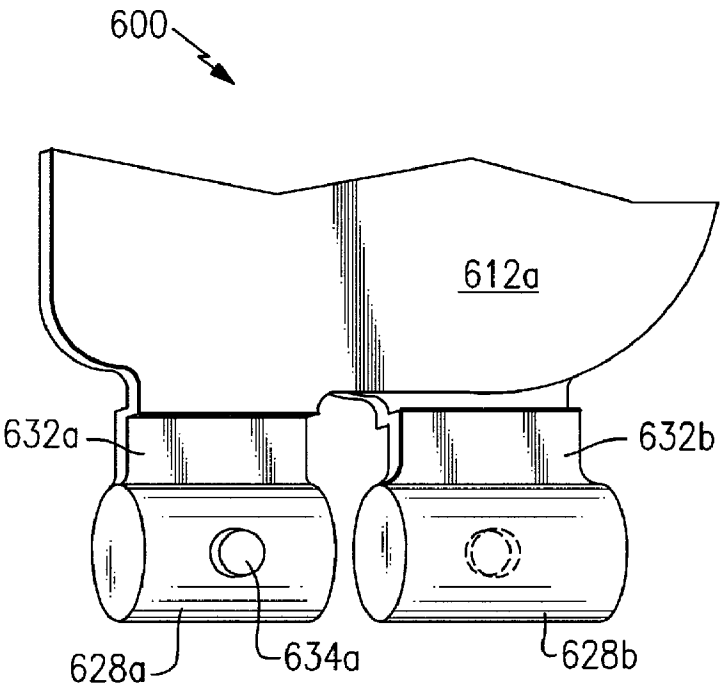
FIGS. 10A-10D schematically illustrate an exterior view of tool inserts according to another embodiment of the invention.
Figure 10A:
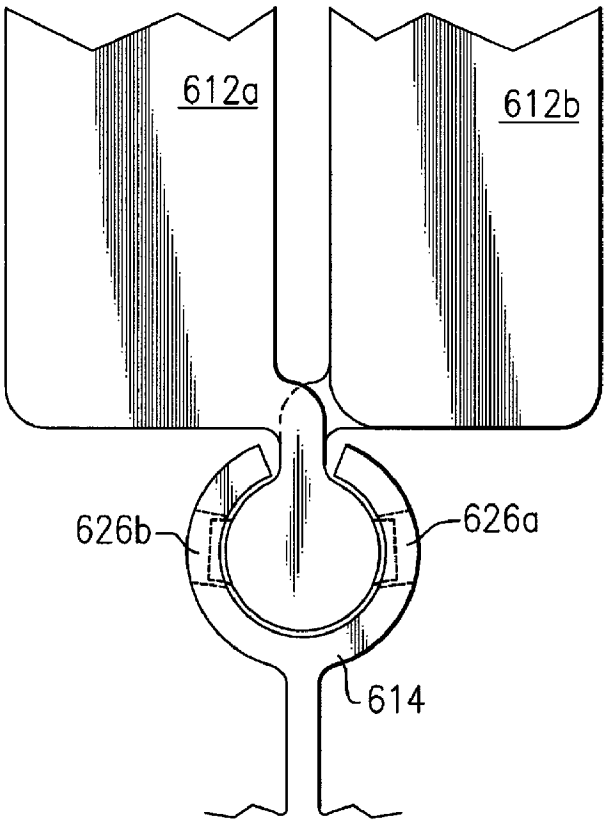

Referring to FIGS. 10A and 10B of the drawings, another embodiment of the firearm cleaning kit 600 includes a plurality of tool inserts 612*a*, 612*b* secured to the interior of the case 602 by a common attachment element 614. In the example shown, the stem 632*a*, 632*b* of each tool insert 612*a*, 612*b* is offset from the centerline CL by a distance S1, S2 of the respective insert in order to accommodate multiple detachable portions 628*a*, 628*b*. In the illustrated embodiment, the cylindrical element 630*a*, 630*b* of each tool insert 612*a*, 612*b* may include a respective detent 634*a*, 634*b* (hidden) to engage with the engagement recesses 626*a*, 626*b* on opposing sides of the attachment element 614.

Figure 10C:
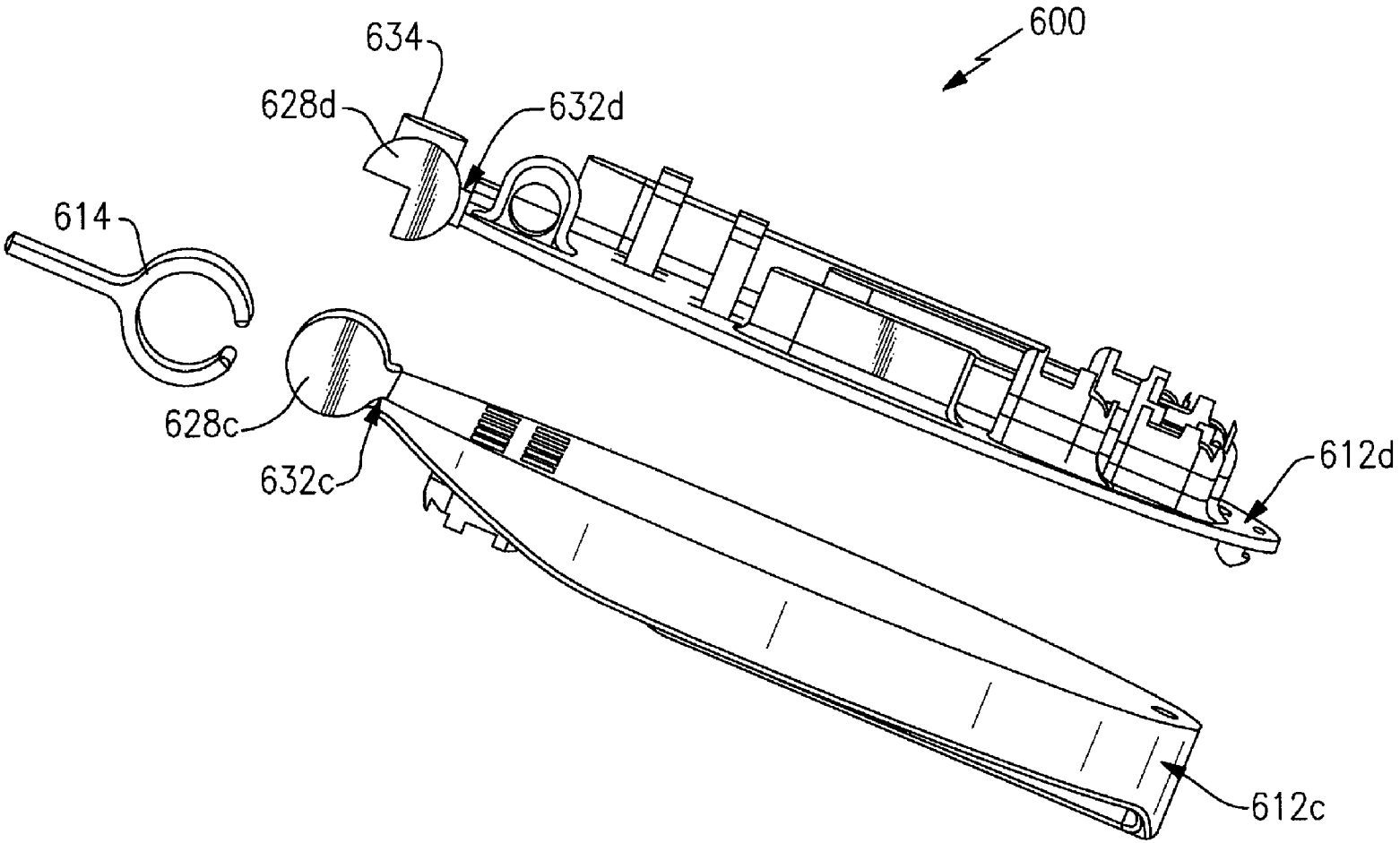
Figure 10D:
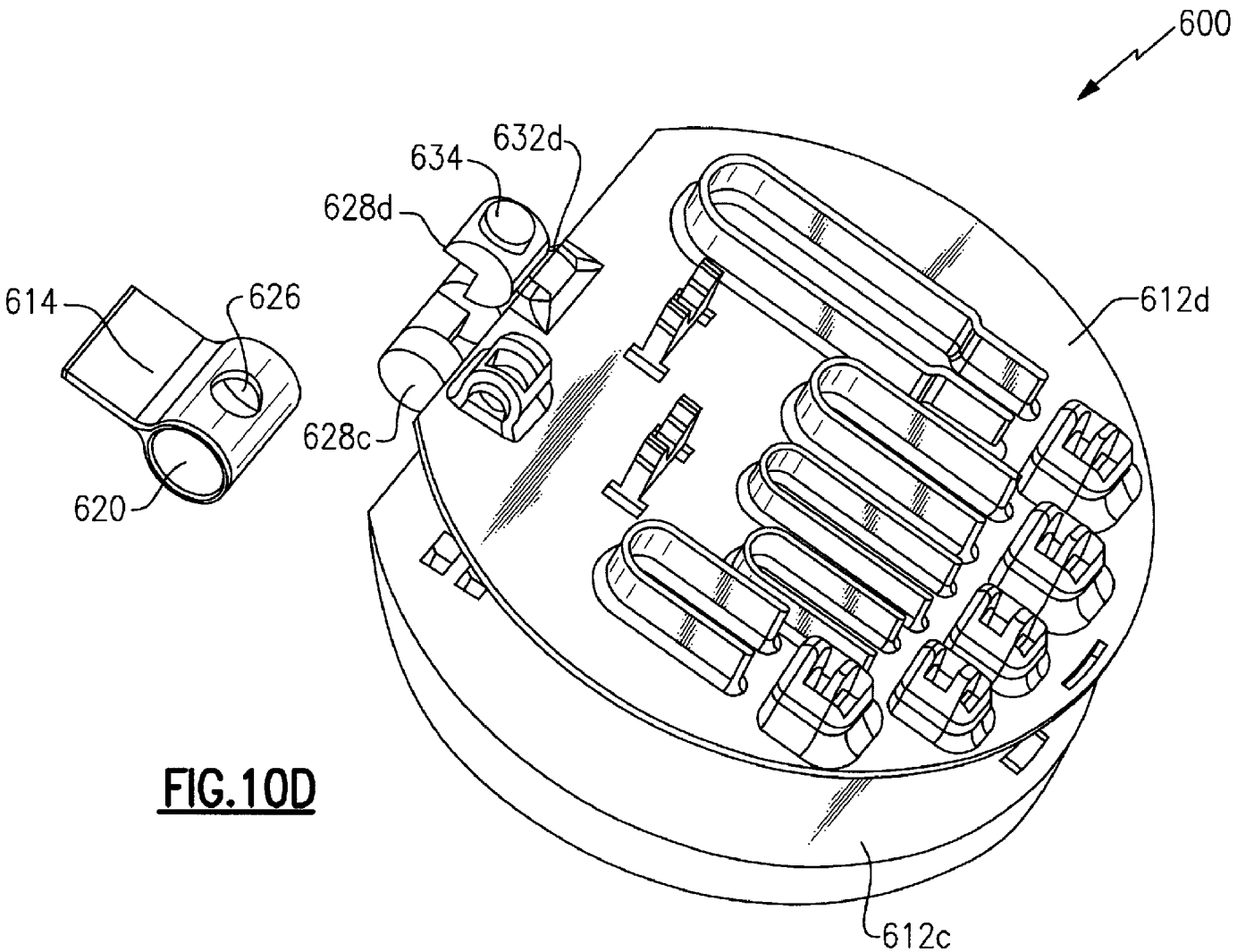

FIGS. 10C and 10D illustrate another embodiment of the attachment element 614 for the firearm cleaning kit 600. The plurality of tool inserts 612*c*, 612*d* stack on top of each other. A detachable portion 628*d* of insert 612*d* nests and interlocks into a detachable portion 628*c* of insert 612*c* to form a unitary cylindrical structure, similar to the cylindrical element 130 illustrated in FIG. 2. The single detent 634, when engaged with the engagement recess 626, prevents the cylindrical element from sliding out of the bore 620 in the clamp 618.

One benefit of the disclosed firearm cleaning kit is that the flexible nature of the tool insert allows faster removal and replacement of the tools. This can be particularly advantageous when time is of the essence, such as in military applications when a soldier may not have a great deal of time to clean his or her weapon.

Another benefit of the disclosed firearm cleaning kit is that it simpler to manufacture than other kits having foam cutouts to store tools. The tool insert disclosed hereinabove may be molded in a single step, rather than cutting out tool inserts from foam and adhering the foam to a rigid back plate.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

I claim:

1. A firearm cleaning kit comprising:

a case having a first side and a second side joined along a fold line;

a fastener for joining together the first and second side of the case;

a tool insert secured to an interior region of the case, the tool insert comprising a base portion joined to a flexible back plate, the base portion comprising a tool base cavity, the flexible back plate comprising a raised wall defining a tool tip enclosure, the tool tip enclosure in alignment with the tool base cavity; and a firearm cleaning tool comprising an attachment base secured within the tool base cavity and a tool tip ensconced within the tool tip enclosure.

2. The firearm cleaning kit of claim 1, wherein the tool insert is releasably secured to the interior of the case by an attachment element.

3. The firearm cleaning kit of claim 2, wherein the attachment element comprises a fixed portion and a detachable portion, the fixed portion being permanently secured to the interior region of the case and the detachable portion engaging the fixed portion.

4. The firearm cleaning kit of claim 3, wherein the fixed portion of the attachment element comprises a clamp along a longitudinal axis, the clamp comprising a slot along the longitudinal axis, a bore along the longitudinal axis defined by an inner circular surface of the clamp, and an engagement recess on an outer surface of the clamp, the engagement recess aligned perpendicular to the longitudinal axis.

5. The firearm cleaning kit of claim 4, wherein the detachable portion of the attachment element comprises a cylindrical element with a detent on the cylindrical surface, the cylindrical element adapted to slideably engage within the longitudinal bore of the clamp, the detent adapted to engage the engagement recess in the clamp.

6. The firearm cleaning kit of claim 1, wherein the flexible back plate comprises a rubber compound.

7. The firearm cleaning kit of claim 6, wherein the flexible back plate comprises tetrafluoroethylene.

8. The firearm cleaning kit of claim 1, further comprising a relief between the raised wall and the tool base cavity.

9. The firearm cleaning kit of claim 1, further comprising a plurality of tool base cavities within the base portion and a plurality of raised walls defining a plurality of tool tip enclosures, each tool tip enclosure being aligned with the corresponding tool base cavity.

10. The firearm cleaning kit of claim 9, the tool insert having a first side and an opposing second side, the first side comprising a plurality of first side tool base cavities and a plurality of corresponding first side raised walls defining a plurality of first side tool tip enclosures, the second side comprising a plurality of second side tool base cavities and a plurality of corresponding second side raised walls defining a plurality of second side tool tip enclosures, the first and second side tool base cavities being formed within the base portion.

11. The firearm cleaning kit of claim 10, wherein the raised walls on one side of the tool insert are spaced a distance D from each other, the distance D sufficient to allow the first side tool base cavities to be arranged in an alternating pattern with the second side tool base cavities within the base portion.

12. The firearm cleaning kit of claim 9, further comprising a plurality tool inserts secured to the interior of the case by a single attachment element.

13. The firearm cleaning kit of claim 12, wherein each tool insert comprises a detachable portion, and the single attachment element comprises a single fixed portion and the plurality of detachable portions.

14. A tool insert for a firearm cleaning kit comprising:

a base portion comprising a plurality of tool base cavities;

a flexible back plate joined to the base portion, the flexible back plate comprising raised walls defining a plurality of tool tip enclosures, the tool tip enclosures aligned with respective tool base cavities;

an attachment element for securing the tool insert to the firearm cleaning kit, the attachment element comprising a cylindrical element joined to the base portion by a stem; and a firearm cleaning tool comprising an attachment base and a tool tip, the attachment base secured within one of the tool base cavities and the tool tip ensconced within one of the respective tool tip enclosures;

wherein the flexible back plate is adapted to bend away from the base portion to aide in the removal or replacement of the firearm cleaning tool.

15. The tool insert of claim 14, the cylindrical element further comprises a detent on the outer surface of the cylindrical element.

16. The tool insert of claim 14, wherein the tool base cavities comprise a plurality of slots.

17. The tool insert of claim 14, further comprising a relief between the raised wall and the tool base cavity.

18. The tool insert of claim 14, wherein the flexible back plate comprises a rubber compound.

19. The tool insert of claim 14, further comprising a first side and an opposing second side, the first side comprising a plurality of first side tool base cavities and a plurality of corresponding first side raised walls defining a plurality of first side tool tip enclosures, the second side comprising a plurality of second side tool base cavities and a plurality of corresponding second side raised walls defining a plurality of second side tool tip enclosures, the first and second side tool base cavities being formed within the base portion.

20. The tool insert of claim 19, wherein the raised walls on one side of the tool insert are spaced a distance D from each other, the distance D sufficient to allow the first side tool base cavities to be arranged in an alternating pattern with the second side tool base cavities within the base portion.

* * * * *